United States Patent [19]

Yamada

[11] Patent Number: 4,548,136

[45] Date of Patent: Oct. 22, 1985

[54] TRACK-TRAVELING FOUR-WHEEL VEHICLE

[75] Inventor: Kazuo Yamada, Kawasaki, Japan

[73] Assignee: Togo Japan Inc., Tokyo, Japan

[21] Appl. No.: 529,140

[22] Filed: Sep. 2, 1983

[30] Foreign Application Priority Data

Sep. 16, 1982 [JP] Japan ..... 57-140451[U]
Sep. 16, 1982 [JP] Japan ..... 57-161445

[51] Int. Cl.[4] ..... A63G 7/00; B61D 15/00

[52] U.S. Cl. ..... 105/91; 104/53; 104/63; 104/172 B; 188/38.5

[58] Field of Search ..... 104/118, 120, 53, 63, 104/172 B; 105/91, 92, 95, 142; 280/125, 127; 188/38, 38.5, 62, 82.3, 82.34, 82.4

[56] References Cited

U.S. PATENT DOCUMENTS

| | | | |
|---|---|---|---|
| 551,623 | 12/1895 | Donovan | 105/91 |
| 1,195,380 | 8/1916 | Miller | 105/91 |
| 1,352,141 | 9/1920 | Outcalt | 280/125 |
| 1,642,276 | 9/1927 | Strickler | 104/63 |
| 1,840,988 | 1/1932 | Traver | 104/53 |

FOREIGN PATENT DOCUMENTS

| | | |
|---|---|---|
| 57-11806 | 1/1982 | Japan . |
| 47526 | 6/1889 | Fed. Rep. of Germany . |
| 677391 | 6/1939 | Fed. Rep. of Germany . |
| 691677 | 6/1944 | France . |

*Primary Examiner*—Robert B. Reeves
*Assistant Examiner*—Dennis C. Rodgers
*Attorney, Agent, or Firm*—Merchant, Gould, Smith, Edell, Welter & Schmidt

[57] ABSTRACT

A track-traveling four-wheel vehicle is arranged such that pedalling power of a passenger is transmitted to rear wheels as drive wheels through a chain, and the rear wheels and front wheels as driven wheels roll along two rails. The vehicle has: frames constituting a rectangular body; a swing frame arranged such that an L-shaped end portion is pivotally mounted in the middle portion of the rear frame through a vertical shaft and the other L-shaped end portion extends along the longitudinal direction of the body, the swing frame being supported to swing in a horizontal plane; and a driven wheel support frame pivotally supported at the distal end portion of said swing frame. The front frame is slidably supported in the vicinity of the distal end portion of the swing frame through a sliding support mechanism.

6 Claims, 16 Drawing Figures

TRACK-TRAVELING FOUR-WHEEL VEHICLE

BACKGROUND OF THE INVENTION

The present invention relates to a track-traveling four-wheel vehicle suitably adapted to serve as an amusement four-wheel vehicles which travels along a track having a pair of rails by means of pedalling or power.

In general, track-traveling vehicles used in an amusement ride in an amusement park travel along a track comprising a combination of straight and curved paths. The track is conventionally constituted by a single rail to allow free travel along a curved path. Furthermore, a saddle-type vehicle as described in Japanese Utility Model Publication No. 11806-1982 or a suspension-type vehicle have been proposed which travel along a single rail.

However, in order to ensure the safety of vehicles traveling along a single rail, the saddle-type vehicle requires a mechanism for lowering the center of gravity of the vehicle body; and the suspension-type vehicle requires various types of complicated safety mechanisms. Therefore, conventional amusement vehicles have serious mechanical design problems. Even if a safety mechanism is provided on a conventional vehicle, the vehicle body is heavy. As a result, easy travel is difficult when such a vehicle is used as a pedal-driven vehicle.

One proposal is a double rail track that is used in place of the single rail track, and a four-wheel vehicle that is employed to travel along the double rail track safely and comfortably. In this case, the four-wheel vehicle must travel along a curved track having two rails. Therefore, all four wheels, or either the front or rear wheels of the vehicle must move about a swingable shaft so as to allow smooth travel of the vehicle along the two curved rails. In four-wheel vehicles of this type, the rear axle is immovably fixed on the vehicle body, and the front axle is swingably mounted on a center plate extending from the bottom of the vehicle body through a center plate support. When the vehicle approaches a curve, the front wheels are forcibly guided along the curved rails whereupon the front axle swings, allowing travel on a curved surface. However, such a four-wheel vehicle traveling along the two rails cannot handle a sharp curve. Therefore, it is impossible to effectively utilize a narrow amusement park space as an amusement ride area through use of sharp curves, nor is it possible to provide the thrills associated with sharp curves.

A four-wheel vehicle suitable for curved travel has also been proposed wherein both the front and rear wheels swing. This four-wheel vehicle has a small radius of rotation at a curve or a corner. Therefore, a narrow amusement park area can be effectively utilized, and greater thrills can be provided. Furthermore, since the vehicle can smoothly turn the corner, only a small friction resistance between the wheels and the rails occurs. As a result, even if the vehicle is driven by pedalling, the passenger (driver) will not tire easily. However, since the rear wheels are swingable, it is very difficult to transmit power thereto, resulting in a complex driving force transmission mechanism. For that reason, the above-mentioned vehicle is not suitable as an amusement ride vehicle. The rotational force is transmitted from a large sprocket of a pedal mechanism to a small sprocket of the rear axle through a chain. In this case, the chain must remain in a single plane to avoid chain removal. Therefore, it is very difficult to swing the rear axle in accordance with conventional techniques.

In a track of such track-traveling amusement rides, since a flat course becomes monotonous, a winding track having ups and downs is preferred. In other words, up and down inclines and switch backs are formed along the track. Furthermore, a drive mechanism is used to pull the vehicle up to the top of an incline so as to allow the vehicle to plunge downward by its own weight. A vehicle for traveling along such a track generally has a brake unit, so that the passenger can operate the brake to adjust the speed of or stop the vehicle. However, if the passenger operates the brake during an interval wherein the vehicle is adapted to climb up the next hill by through inertia or by a combination of inertia and a pedalling force, the vehicle cannot climb the hill, and stops in a valley. Even worse, the subsequent vehicle may collide with the vehicle stopped in the valley. Furthermore, when the passenger operates the brake during intervals wherein maintenance personnel are operating a drive mechanism to pull the vehicle up to the top of a hill or to guide the vehicle to a predetermined platform position, the drive mechanism break, resulting in a dangerous situation.

SUMMARY OF THE INVENTION

The present invention has been made in consideration of the above situations and one object of the invention is to provide a simple track-traveling four-wheel vehicle suitable for use as a pedal-operated bicycle in an amusement ride, wherein the vehicle can turn corners stably and travel smoothly.

It is another object of the present invention to provide a track-traveling four-wheel vehicle which does not allow a passenger to operate a brake where the brake should not be operated thereby achieving smooth travel and preventing undesirable stops, traffic jams, accidents and breakdown of the drive mechanism.

According to one aspect of present invention, there is provided a track-traveling four-wheel vehicle as an amusement ride vehicle traveling along two rails such that drive wheels mounted at one of front and rear ends of a vehicle body are driven by passenger manpower such as pedalling, or by a motor mounted in the vehicle body. The track-traveling four-wheel vehicle has a swing frame mechanism which is swingable within a horizontal plane and independent of a body frame. There is also provided a vertical shaft at a middle portion of a first transverse frame of body frames constituting a rectangular shape, the first transverse frame being located on the side of the drive wheels, one end portion of a swing frame extending along the longitudinal direction of the body pivoted about the vertical shaft and the other end portion thereof slidably supported on a second transverse frame of the body frames. The second transverse frame is located on the side of the driven wheels, with a distal end of the other end portion of the swing frame pivotally mounted at the middle portion of a driven wheel support frame, whereby the drive wheels are positioned to be stationary with respect to the body frame so as to properly transmit power to the driven wheels, and the driven wheels can swing in the horizontal direction upon pivotal movement of the driven wheel support frame pivoted at the distal end of the swing frame.

According to another aspect of the present invention, there is provided a track-traveling four-wheel vehicle having a brake switching mechanism wherein a dog disposed in the track at a beginning of an interval wherein a brake should not be operated disables the brake, and another dog disposed at an end thereof which enables the brake, thereby ensuring incident-free travel of successive vehicles along the track.

The track-traveling vehicle of the present invention is not limited to a pedal-operated two-seater having four wheels. For example, the present invention may be applied to a vehicle operated by hand movement or by a motor. The drive wheels may be located at the rear or at the front. The positions of the swing frame and the driven wheel support frame must be reversed when the positions of the drive wheels are reversed.

DETAILED DESCRIPTION OF THE PREFERRED EMBODIMENTS

Figure 1:
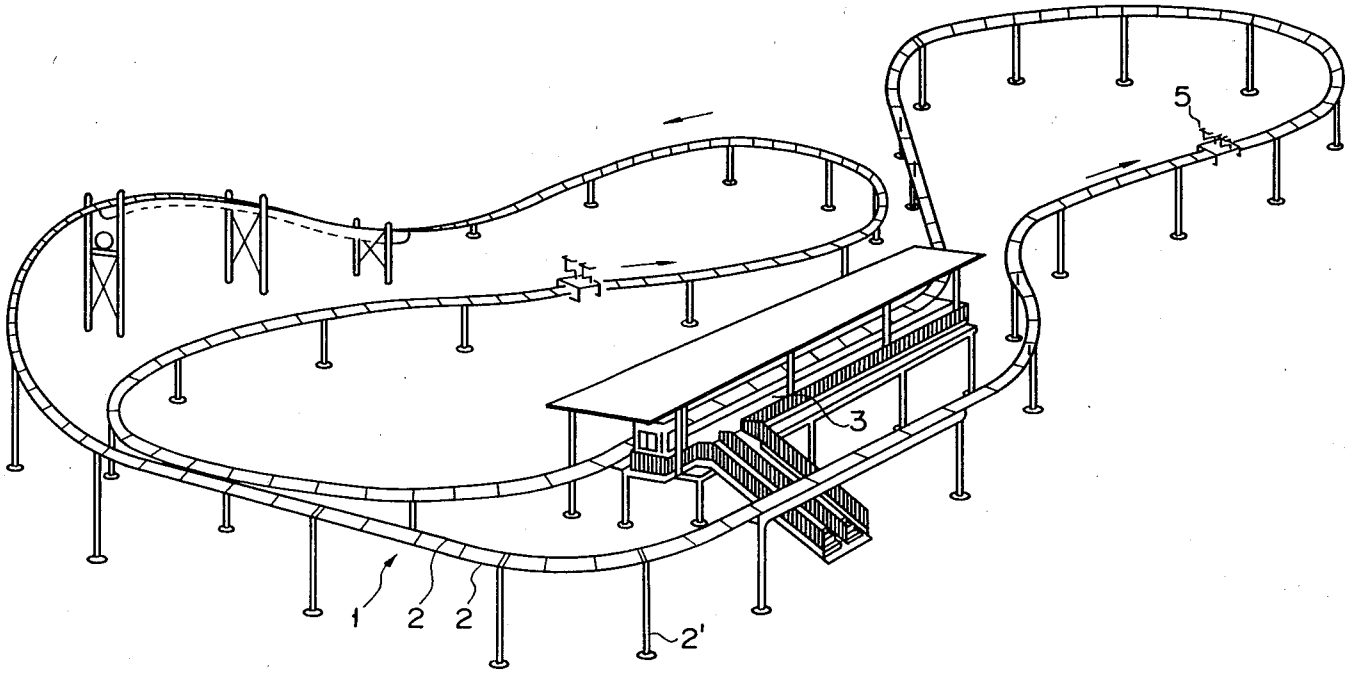
FIG. 1 is a perspective view schematically showing a track having two rails.
Figure 3:
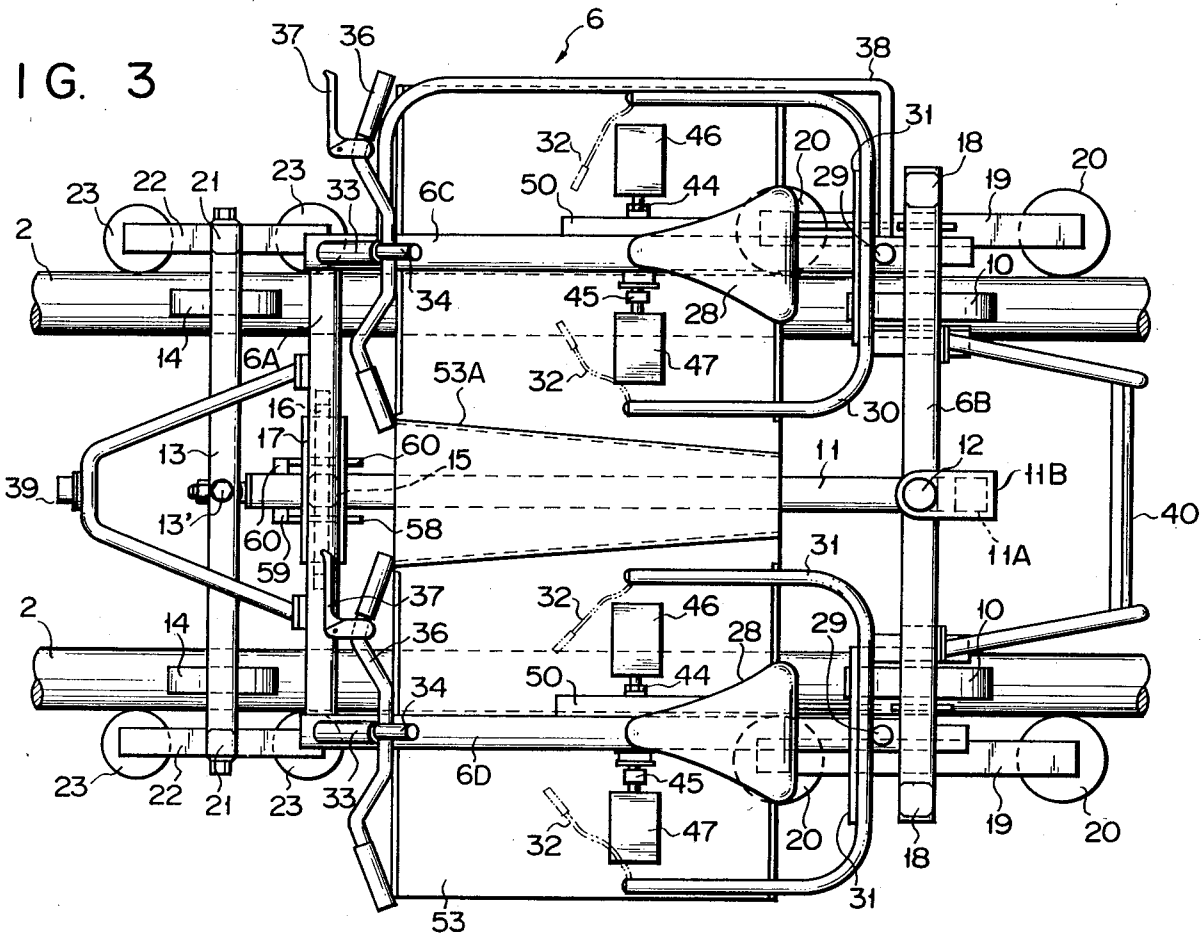
FIG. 3 is a plan view of the four-wheel vehicle shown in FIG. 2.
Figure 4:
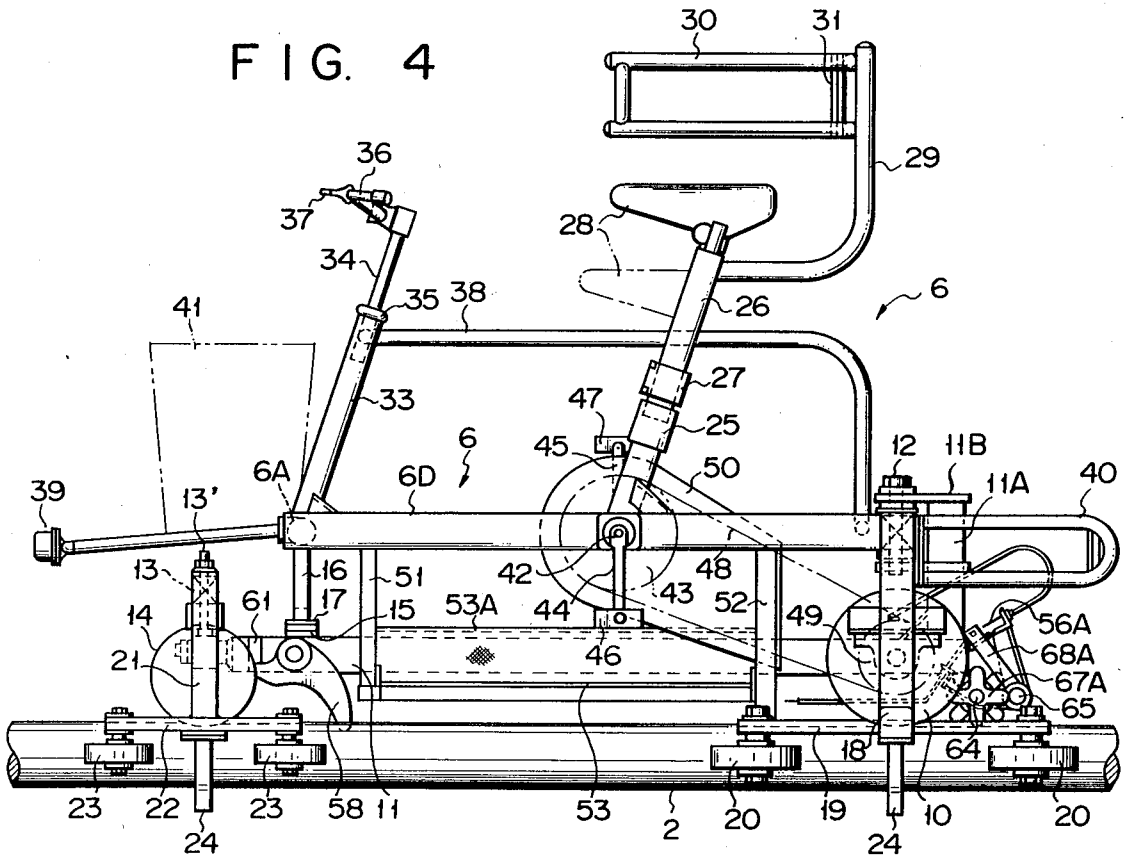
FIG. 4 is a side view of the four-wheel vehicle shown in FIG. 2.
Figure 5:
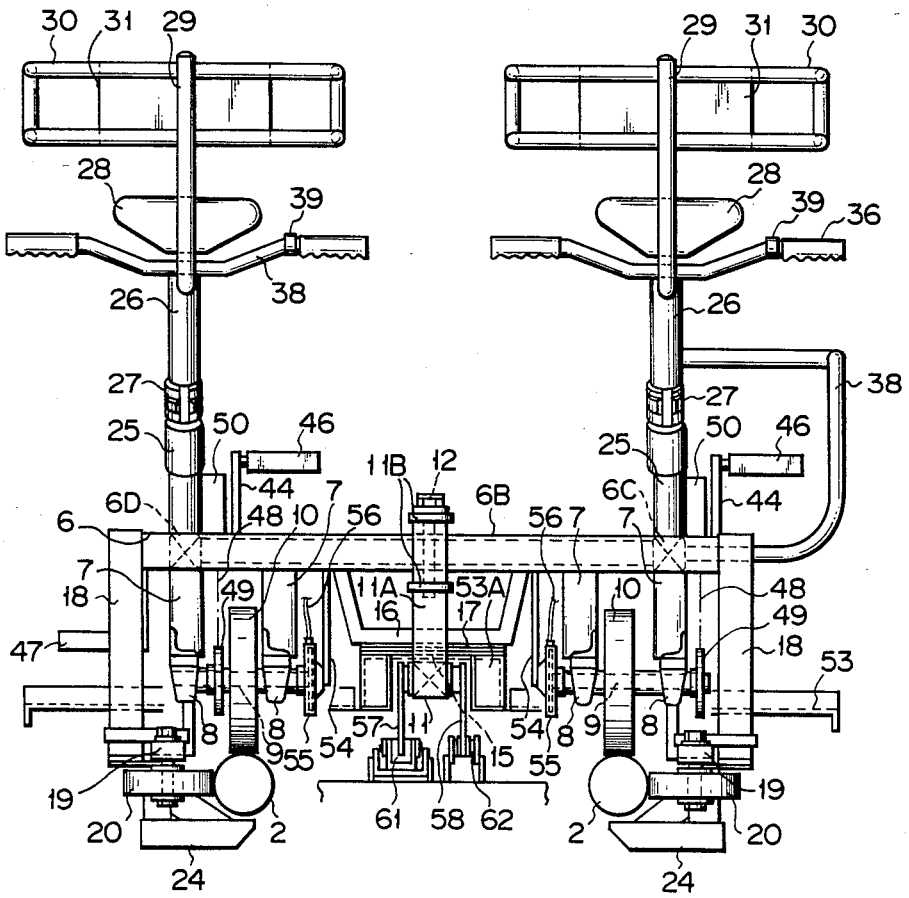
FIG. 5 is a rear view of the four-wheel vehicle shown in FIG. 2.

Reference numeral 1 in FIG. 1 denotes a track having two round pipe rails 2. The track 1 is supported by a plurality of columns 2' at a high above the ground so as to constitute an endless course having curves and up and down inclines. Reference numeral 3 denotes a platform. A four-wheel vehicle 5 for two passengers (drivers) 4 seated along the width thereof is positioned at the platform 3. A vehicle body 6 has a rectangular shape constituted by front and rear frames 6A and 6B and right and left frames 6C and 6D, as shown in FIGS. 3 to 5. These frames are made of round or square steel pipes, respectively. A pair of brackets 7 extend downward at each end portion of the rear frame 6B of the body 6. Rear wheels 10 are respectively mounted at two ends of a rear axle 9 rotatably supported through bearings 8 mounted at the lower ends of the brackets 7. Reference numeral 11 denotes a swing frame disposed at the lower central portion of the body 6 and extending along the longitudinal direction of the body 6. A rear end stand 11A of the frame 11 is pivotally mounted via a pair of upper and lower support arms 11B on a vertical shaft 12 at the middle portion of the rear frame 6B, so that the swing frame 11 is supported by the vertical shaft 12 to be swingable in a horizontal direction. The front end of the swing frame 11 is rotatably mounted on a swing shaft 13' rotatably extending through the middle portion of a transverse front wheel support frame 13. The front wheel support frame 13 is thus supported to pivot about the swing shaft 13'. Front wheels 14 are mounted at the end portions of the support frame 13 through brackets and bearings (not shown), respectively. A sliding support 15 is disposed at the upper surface of a portion just within the front end of the swing frame 11. A U-shaped bracket 16 is disposed at the lower surface of the front frame 6A of the body 6 so as to oppose the sliding support 15. A transversely elongated sliding plate 17 is disposed on the lower surface of the U-shaped bracket 16. The sliding plate 17 is slidably mounted on the sliding support 15 of the swing frame 11, so that the body 6 is supported at a predetermined height.

Support rods 18 extend downward from the two ends of the rear frame 6B of the body 6, respectively. Support plates 19 are mounted at the lower ends of the support rods 18 to extend along the longitudinal direction of the body, respectively. Rear wheel guide rollers 20 are rotatably supported at the front and rear lower surface portions, respectively, of each support plate 19. The guide rollers 20 are in rolling contact with the outer side surfaces of the rails 2. Support rods 21 extend downward from the two ends of the front wheel support frame 13 of the body. Support plates 22 extending along the longitudinal direction of the body are mounted at the lower ends of the support rods 21. Front wheel guide rollers 23 are rotatably mounted on front and rear lower surface portions, respectively, of each support plate 21 in the same manner as the rear wheel guide rollers 20. Therefore, the guide rollers 23 are in rolling contact with the outer side surfaces of the rails 2.

Wheel float preventive plates 24 are disposed at the middle portions of the support plates 19 and 22 so as to oppose the lower surfaces of the rails 2, respectively. Saddle support cylinders 25 extend upward from the middle portions of the right and left frames 6C and 6D, respectively, in a backwardly inclined manner. Saddle support rods 26 are fitted in the saddle support cylinders 25, so that the heights of the saddles can be adjusted by adjusting pieces 27, respectively. Saddles 28 are respectively mounted on the top ends of the saddle support rods 26. L-shaped support pipes 29 extend from the rear surfaces of the upper ends of the saddle support rods 26, respectively. Safety frames 30 surrounding the saddles 28 in a U-shaped manner are mounted at the upper ends of the support pipes 29, respectively. Back plates 31 are mounted on the inner surfaces of the frames 30, respectively. A pair of safety straps 32 which hold the passenger are mounted at the two ends of each safety frame 30, as indicated by the imaginary line in FIG. 3.

Handlebar support cylinders 33 are coupled at the front ends of the right and left frames 6C and 6D of the body 6, respectively, in a backwardly inclined manner. A handlebar support rod 34 is fitted in each handle support cylinder 33 and is fixed by a pipe holder 35. Handlebars 36 are mounted at the upper end of each handlebar support rod 34. Reference numeral 37 denotes a brake lever disposed at a right grip portion of each set of handlebars 36.

Reference numeral 38 denotes a barrier having a U-shaped section at the right side of the body 6 along the travel direction. The front end of the barrier 38 is connected to the handlebar support rod 34, and the rear end thereof is connected to the rear end of the right frame 6C. Reference numerals 39 and 40 denote bumpers extending forward and backward from the front and rear frames 6A and 6B of the body, respectively. Reference numeral 41 indicated by the imaginary line (FIG. 4) above the bumper 39 denotes a basket for temporarily storing personal belongings of the passengers.

Pedal mechanisms for driving the vehicle body 6 by pedalling are disposed immediately below the saddles 30, respectively. Each pedal mechanism comprises a crankshaft 42 extending from a middle portion of the frame 6C or 6D, a large sprocket gear 43 mounted on the right end of the crankshaft 42, right and left cranks 44 and 45 mounted at two ends of the crankshaft 42, and pedals 46 and 47. A small sprocket gear 49 interlocked with the large sprocket gear 43 through a chain 48 is mounted on each end portion of the rear axle 9. Reference numeral 50 denotes a chain cover for covering the large sprocket gear 43 and the front portion of the chain 48 of a corresponding pedal mechanism.

Two pairs of suspension rods 51 and 52 extending downward from the right and left frames 6C and 6D support a floor plate 53. The floor plate 53 is disposed below the pedals 46 and 47 so as not to interfere with rotational movement of the pedals 46 and 47. A projection 53A having an inverted U shape is formed at the central portion along the body so as not to interfere with swinging movement of the swing frame 11.

Figure 2:
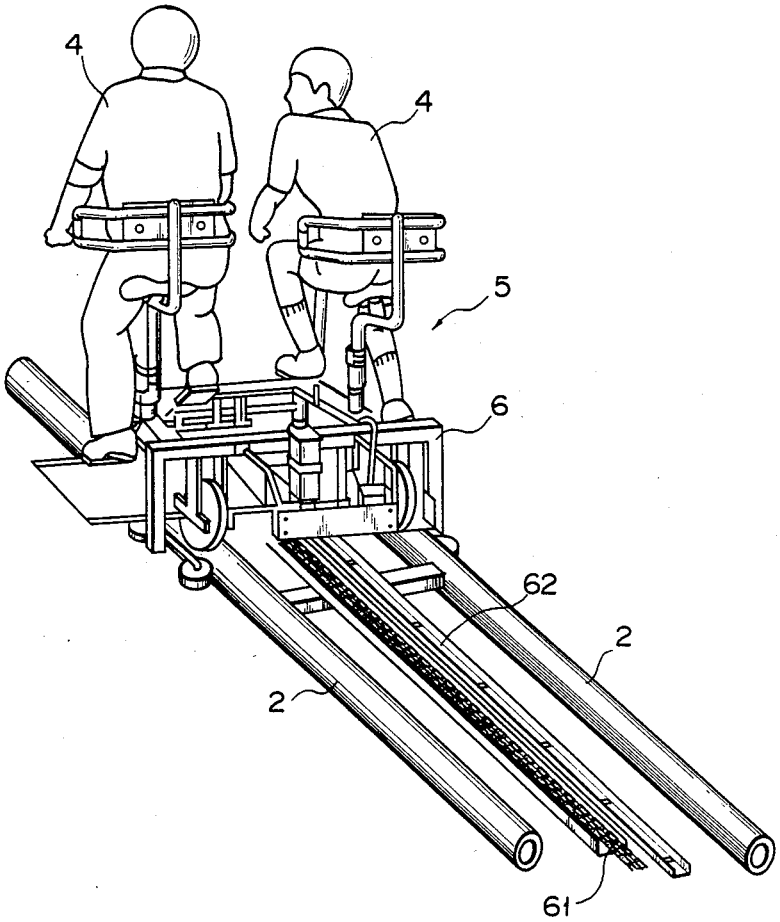
FIG. 2 is a perspective view schematically showing a four-wheel vehicle traveling along the track.

As shown in FIG. 5, brake units are constituted by band brakes 55 through brackets 54 extending downward the rear frame 6B to the insides of the rear wheels 10, respectively. The brake unit of this type is operated such that rotation of a drum is stopped by brake shoes. The band brakes 55 are operated through tension wires 56 activated upon grasping the brake levers 37 mounted on the handlebars 36, respectively. A wind-up hook 57 and a reverse travel preventive hook 58 are rotatably mounted to clamp the frame 11 at the front end portion thereof, as shown in FIGS. 4 and 5. These hooks pivot through their own weight such that the rear portion with respect to the fulcrum is moved to extend downward, and that the front portion therewith abuts against stoppers 59 and 60 for regulating further pivotal movement of the front portion. The rear portions of the hooks 57 and 58 engage with a wind-up chain 61 and a reverse travel preventive pin rack 62 which are disposed inside and along the rails 2, respectively, as shown in FIGS. 2 and 5. Therefore, the vehicle body 6 can be wound up an up incline and will not travel in the reverse direction.

Figure 6:
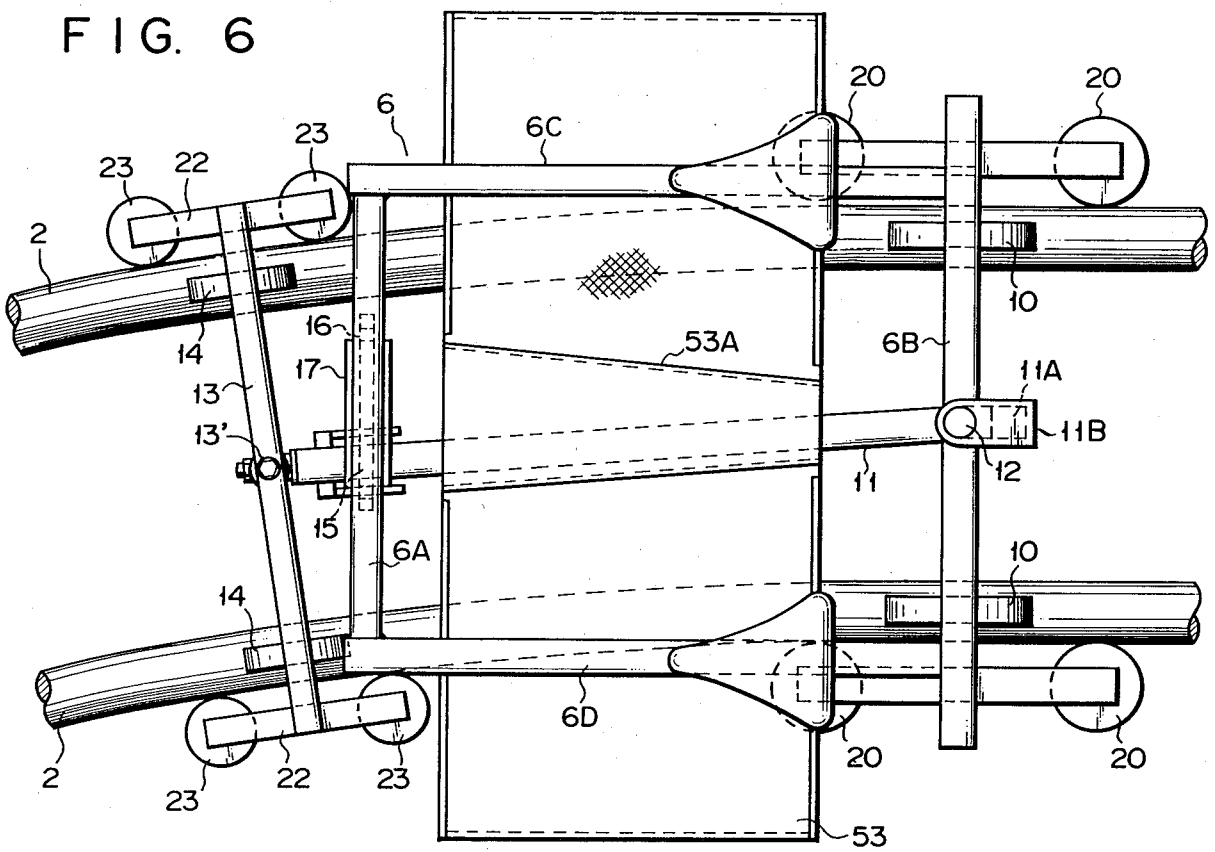
FIG. 6 is a plan view showing the operating condition of the main part of the four-wheel vehicle (FIG. 2) while in motion.

As described above, the four-wheel vehicle has the swing frame 11 swingable about the vertical shaft 12 mounted on the rear frame 6B of the rectangular body 6, the front frame 6A of the body 6 which is slidably supported on the swing frame 11, and the front wheel support frame 13 supported to pivot about the swing shaft 13' mounted on the swing frame 11. Therefore, as shown in FIG. 6, when the vehicle is about to turn a curve or corner, the front wheel support frame 13 and the front wheels 14 are pivoted along the tracks when swing frame 11 swings under the body 6. However, the position of the rear wheels 10 mounted on the rear axle 9 does not change with respect to the body frame. Therefore, the body frame is guided by the swing frame 11 and the front wheel support frame 13 along the curve such that the body frame is slightly misaligned with respect to the travel direction. The front wheels 10 and the rear wheels 14, and the guide rollers 20 and 23 will not separate from the rails 2 when the vehicle travels along a sharp curve, thereby providing very smooth and comfortable travel. Furthermore, since the rear axle 9 is held at a given position relative to the body frame, a complex transmission mechanism need not be used to transmit power from the pedals to the rear wheels 10 through the chain 48 of each pedal mechanism. As a result, a simple, light-weight power transmission mechanism can be used. In addition to this advantage, the four-wheel vehicle described above can travel along a sharp curve, so that a sophisticated track effectively using a compact area of an amusement park can be obtained wherein various types of up and down inclines and cants can be provided to enjoy "sky cycling".

The front end of the swing frame 11 pivotally mounted at the middle portion of the front wheel support frame 13 substantially passes along a central line between the rails 2 along either a straight or curved track portion. The wind-up hook 57 and the reverse travel preventive hook 58 are disposed to clamp the front end portion of the swing frame 11, so that the wind-up chain 61 and the reverse travel preventive pin rack 62 which are disposed inside the rails 2 can be aligned to properly engage with the corresponding hooks during an up hill interval.

Figure 7:
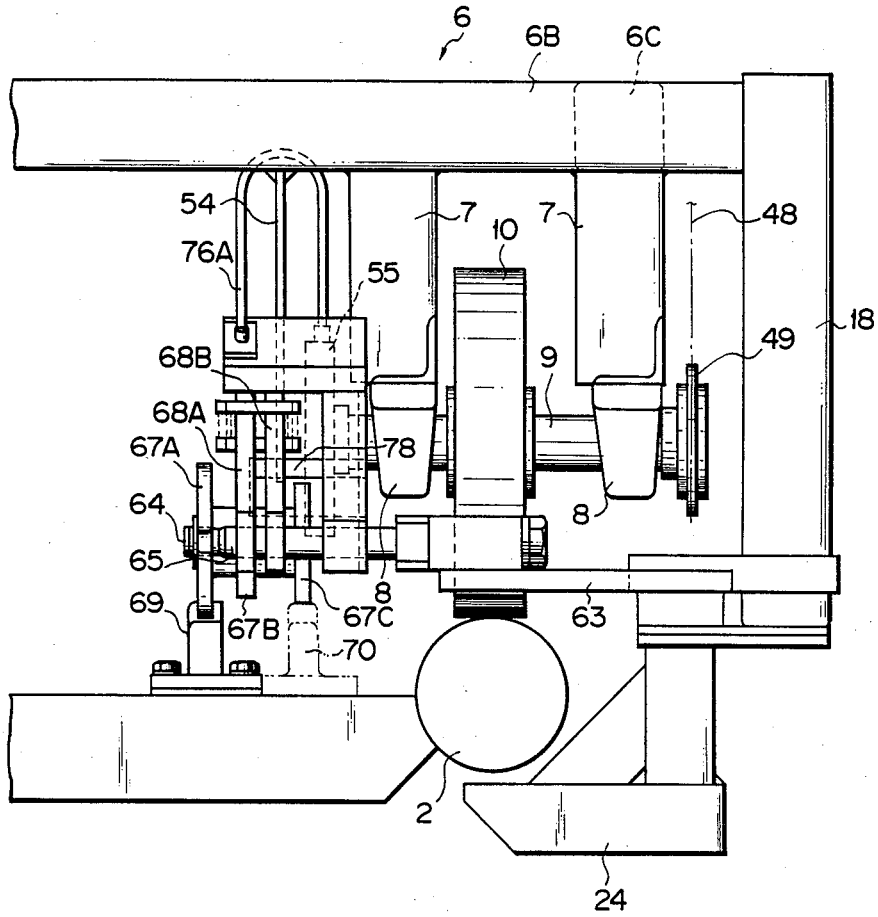
FIG. 7 is an enlarged rear view of a brake switching mechanism disposed at the rear portion of the four-wheel vehicle shown in FIG. 2.

FIGS. 7 to 13 show a detailed configuration of the brake switching mechanism mounted in the four-wheel vehicle of the present invention. One type of brake switching mechanism is illustrated in FIGS. 7 to 11. FIG. 7 shows a fixing plate 63 mounted at the lower end of each support rod 18 suspended from the rear frame 6B of the body 6. One end of each of a cam shaft 64 and a link shaft 65 is connected to the fixing plate 63. The other end of the cam shaft 64 is parallel to that of the link shaft 65. The cam shaft 64 and the link shaft 65 are disposed behind the corresponding rear wheel 10. Three cross-shaped cams 67A, 67B and 67C are coaxially mounted on the cam shaft 64 to be rotatable together through a rotating sleeve 66. A pair of links 68A and 68B are mounted on the link shaft 65 to be rotatable independently of each other. The cross-shaped cams 67A and 67C located at the two ends have the same shape and size, and their phases are shifted by 45°. Downward-directed projections 67A*a*, . . . , and 67C*a*, . . . of these cams abut against dogs 69 and 70 disposed between the rails 2, as shown in FIG. 7, and are rotated in units of 45°. The projection 67B*a* of the middle cross-shaped cam 67B is shorter than those of cams 67A and 67C. The phase of the projections of the cam 67B is the same as that of the cam 67A. Apertures are radially formed in the middle cross-shaped cam 67B. Steel balls 71 are fitted in the apertures through index springs 72 and set screws 73, respectively. The steel balls 71 are further fitted in aligning recesses 64A . . . , arrayed circumferentially in the outer surface of the cam shaft 64 by the biasing forces of the springs 72, thereby regulating 45° rotation of the cross-shaped cams 67A, 67B and 67C.

Figure 8:
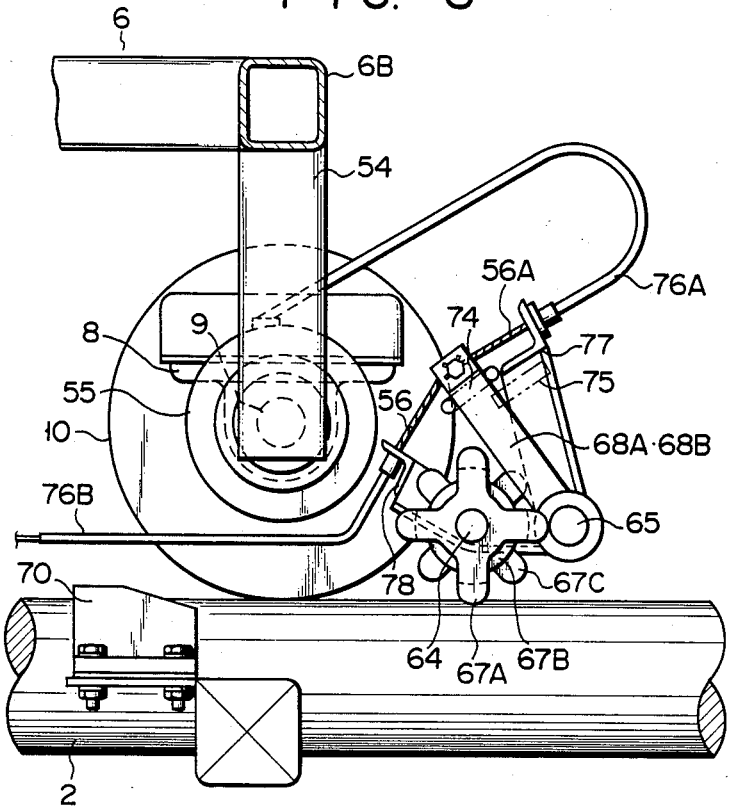
FIG. 8 is an enlarged side view of the brake switching mechanism shown in FIG. 7.
Figure 9:
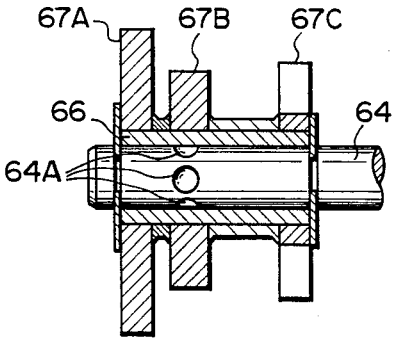
FIG. 9 is a rear view showing the construction of three cams of the brake switching mechanism shown in FIG. 7.
Figure 10A:
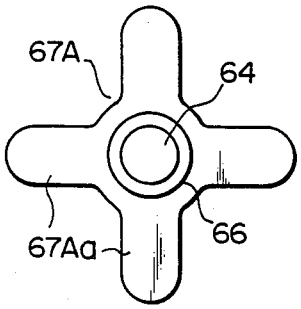
FIGS. 10A to 10C are side views of the three cams shown in FIG. 9, respectively.
Figure 10B:
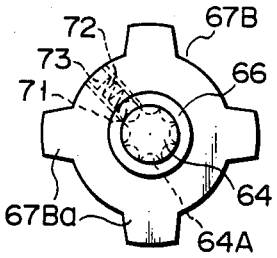
Figure 10C:
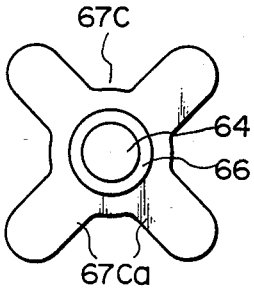

The pair of links 68A and 68B are respectively constituted by rods extending upward from the link shaft 65. The link 68A is disposed to oppose the middle cross-shaped cam 67B, such that the link 68A is pivoted to fall down in front of and abut against the middle cross-shaped cam 67B. However, even if the link 68B is pivoted, it will not abut against any member. The upper portions of the links 68A and 68B are surrounded and coupled by a spring 74. In the normal condition, the links 68A and 68B are biased to overlay each other, as shown in FIG. 8. At the same time, the links 68A and 68B are biased by a return spring 75 in the backward direction. A tension wire 56A has one end connected to the band brake 55 and the other end connected to the upper end of the link 68A. The tension wire 56 guided from the brake lever 37 is connected to the upper end of the link 68B. The wires 56A and 56 are inserted through tubes 76A and 76B, respectively, and each end of the tubes 76A and 76B is fixed to a corresponding end of brackets 77 and 78. One end of the return spring 75 is stopped by the bracket 77.

Figure 11A:
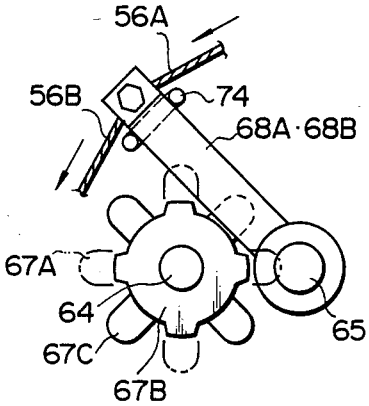
FIGS. 11A and 11B are side views showing the cams and links in different operating conditions.

In the four-wheel vehicle 5 having the brake switching cam mechanism as described above, the normal operating conditions of the mechanism are as shown in FIG. 8. The passenger grasps the brake lever 37 to pull the tension wire 56. The link 68B is pivoted to fall down in front of and against the return spring 75, thereby pivoting the link 68A to follow the action of the spring 74 together with the link 68B, as shown in FIG. 11A. As a result, the tension wire 56A on the side of the band brake 55 is pulled, and the corresponding band brake 55 is operated to stop rotation of the rear axle 9.

Figure 11B:
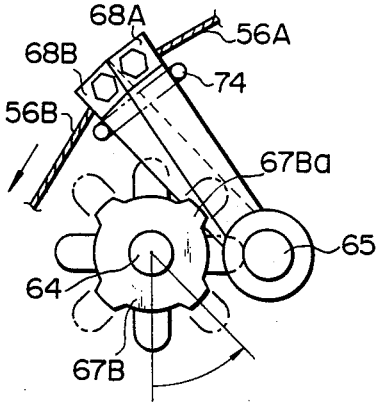

However, when the vehicle reaches a tack interval which has up and down inclines and brake operation is not permitted, the suspending projection 67A*a* of the cross-shaped cam 67A abuts against a dog 69 disposed at the beginning of the track interval. The cross-shaped cams 67A, 67B and 67C are rotated together by 45°, so that the condition shown in FIG. 11A changes to that shown in FIG. 11B. Under this condition, when the passenger 4 grasps the brake lever 37 to operate the brake unit, the tension wire 56 is pulled to pivot the link 68B and make it fall down in front, so that the link 68B pulls the link 68A. However, the link 68A abuts against the projection 67B*a* of the cross-shaped cam 67B and cannot be further pivoted, as shown in FIG. 11B. As a result, the tension force does not affect the tension wire 56A on the side of the brake, and the band brake 55 is held inoperative. In other words, the brake is held inoperative during the above-mentioned interval. The four-wheel vehicle 5 has sufficient inertia to climb up the next incline. When the suspended projection 67C*a* of the cross-shaped cam 67C abuts against a dog 70 disposed at the end (i.e., a hill top) of the interval, the cross-shaped cams 67A, 67B and 67C are rotated by 45° to restore the condition shown in FIG. 11A. Therefore, the brake unit can be properly operated upon operation of the brake lever 37.

When the dogs 69 and 70 are disposed at the beginning and end of the track interval wherein the four-wheel vehicle 5 is forcibly pulled to the top of an incline of the track, the brake is inoperative. As a result, a mechanism such as the wind-up chain 61 can not be broken or overloaded.

Only the rear right side of the body 6 is illustrated in FIG. 7, and the rear left side thereof is omitted. However, a similar brake switching mechanism is also disposed in the left side. When the wires 56 from the brake levers 37 of the right and left passengers are constituted by a single wire, only one band brake 55 and the brake switching mechanism need be provided.

A brake switching mechanism of a four-wheel vehicle according to a second embodiment of the present invention will now be described with reference to FIGS. 12 and 13. A brake switching clutch mechanism is illustrated wherein one end of a brake shaft 80 is coaxially mounted on one end of a rear axle 9 through a meshing clutch 79. The other end of the brake shaft 80 is rotatably supported through a sleeve 82 with respect to a bracket 81 extending downward from a rear frame 6B. The band brake 55 is disposed at the other end of the the brake shaft 80. A shaft box 83 is disposed at the lower end portion of the bracket 81. A rotating shaft 84 is disposed to vertically extend through the shaft box 83. A swinging plate 85 bent at an obtuse angle to be pivotal about the rotating shaft 84 as a fulcrum is mounted at the lower end of the shaft 84, as shown in FIG. 13. The two ends of the swinging plate 85 alternately abut against dogs 86 and 87 disposed on the side of the rails 2 so as to reciprocate together with the rotating shaft 84. A pivot lever 88 is mounted at the upper end of the rotating shaft 84, and an operation pin 89 extends from the top end of the pivot lever 88. The upper end of the operation pin 89 engages with a groove 79A of a sliding plate 79' of the meshing clutch 79. The pivot lever 88 is biased by a reverse rotation retaining spring 91 hooked between the operation pin 89 and a fixed pin 90 extending from the shaft box 83.

Figure 12:
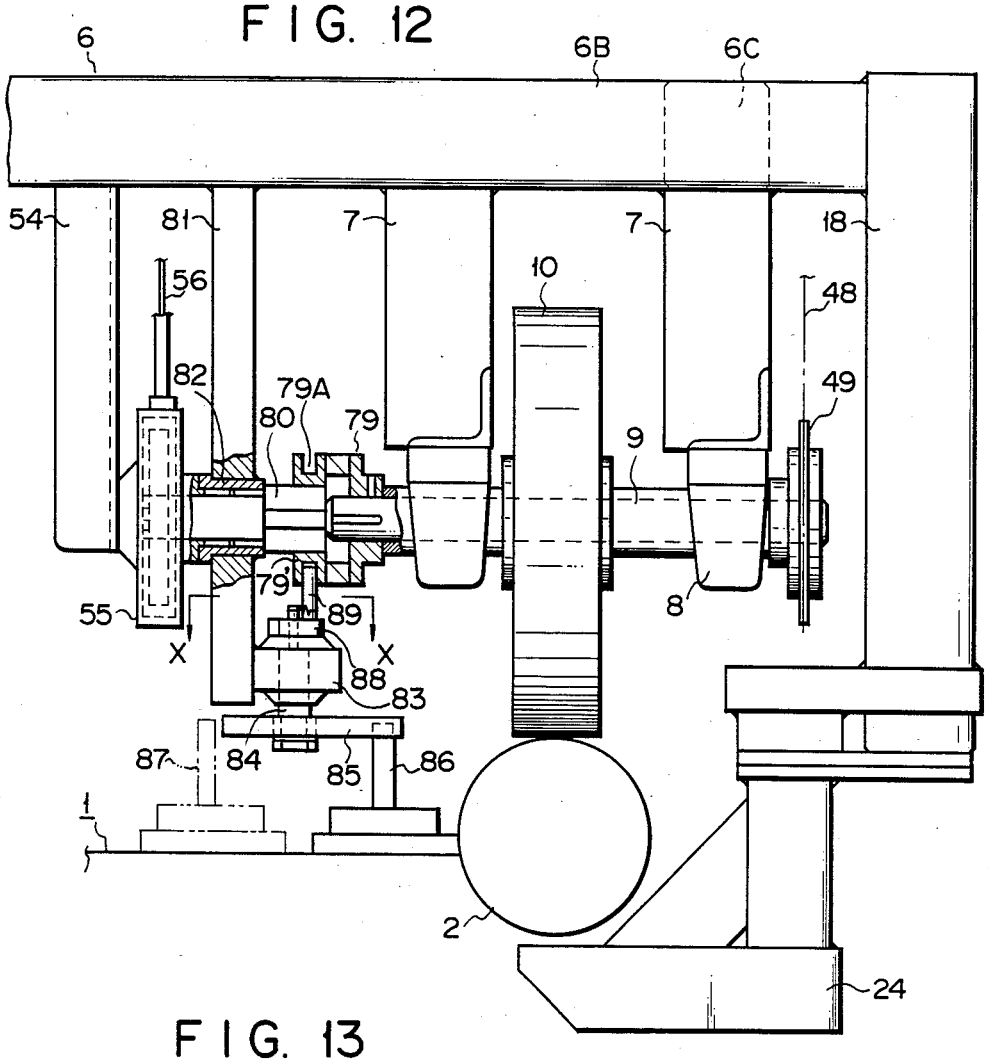
FIG. 12 is an enlarged rear view showing another embodiment of the brake switching mechanism shown in FIG. 7.
Figure 13:
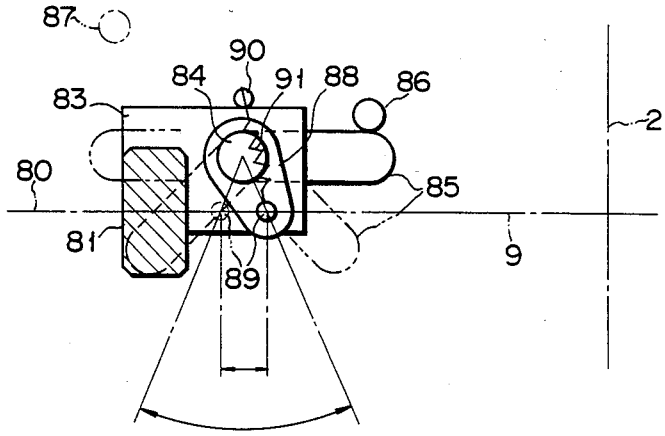
FIG. 13 is a sectional view of the brake switching mechanism shown in FIG. 12, taken along the line X—X thereof.

In the four-wheel vehicle having the brake switching clutch mechanism described above, under normal conditions, the meshing clutch 79 is turned on as shown in FIG. 12, so that the brake shaft 80 is rotated together with the rear axle 9. When the passenger operates the brake lever 37 to pull the tension wire 56, proper braking is applied to the rear axle 9 through the brake shaft 80 and the meshing clutch 76 upon actuation of the band brake 55. However, when the four-wheel vehicle 5 has reached an interval where the brake units are inoperative, as previously described, one side of the swing plate 85 abuts against the dog 86 at the beginning of the interval, so that the swing plate 85 is pivoted. The pivot lever 88 is pivoted together with the swing plate 85 through the rotating shaft 84. The operation pin 89 is shifted to the position indicated by the imaginary line in FIG. 13. Upon movement of the operation pin 89, the sliding plate 79' with the groove 79A of the clutch 79 is moved along the brake shaft 80, thereby terminating the meshing relationship. The clutch 79 is thus turned off. In this condition, when the passenger grasps the hand brake lever 37, the tension wire 56 is pulled so that the band brake 55 acts to stop rotation of the brake shaft 80. However, since the meshing clutch 79 is kept OFF, a braking force does not act on the rear axle 9. As a result, the four-wheel vehicle 5 travels while the brake units are held inoperative. When the other side of the swing plate 85 abuts against the dog 87 at the end of the interval, the rotating shaft 84 is pivoted together with the pivot lever 88 in a direction opposite to that mentioned previously. The operation pin 89 is shifted to the position indicated by the solid line in FIG. 12. The meshing clutch 79 is then turned on, as shown in FIG. 12. Therefore, proper braking can be performed upon operation of the brake lever 37, thereby obtaining the same effect as in the brake switching cam mechanism of the first embodiment.

What is claimed is:

1. A track-traveling four-wheel vehicle for traveling by rolling along two rails such that a pair of drive wheels mounted on an axle of one of front and rear ends of a body are driven by manpower such as pedalling by a passenger or power such as a motor mounted in the body, roll together with a pair of driven wheels along the two rails, wherein said vehicle is comprised of: frames constituting said body of said vehicle and including an end frame located on the same side as that where the drive wheels are located; a vertical shaft mounted at a middle portion of the end frame; a swing frame having a proximal end portion which is pivotally mounted on said vertical shaft and distal end portion which is located below said body, said swing frame extending along a longitudinal direction of said body and being adapted to swing in a horizontal plane about said proximal portion thereof; a driven wheel support frame having a middle portion which is pivotally mounted on said distal end portion of said swing frame, said driven wheels being mounted at two ends of said driven wheel support frame; a support mechanism located on an upper surface of said distal end of said swing frame and which slidably supports another end frame of said frames which is located on the same side as that where said driven wheels lie, said another end frame being supported on the upper surface of said distal end portion of said swing frame; and a brake unit for braking said drive wheels upon operation of a brake lever by the passenger, said brake unit having a brake switching mechanism comprising an abutment member which nullifies the braking action upon abutting against a dog disposed between said rails at the beginning of a brake inhibiting interval of said track and restores the braking action upon abutting against another dog disposed at the end of the brake inhibiting interval.

2. A vehicle according to claim 1, wherein said brake unit comprises a brake for braking said drive wheels through a tension element upon operation of a brake lever by the passenger.

3. A vehicle according to claim 2, wherein said brake switching mechanism further comprises inhibiting means or inhibiting operation of said tension wire when said abutment member pivots upon abutting against said dog at the beginning of the brake inhibit interval.

4. A vehicle according to claim 2, wherein said brake switching mechanism further comprises releasing means for releasing a brake transmission mechanism of said brake unit when said abutment member pivots upon abutting against said dog.

5. A vehicle according to claim 1 wherein said brake switching mechanism further comprises restraining means for inhibiting operation of said tension element when said abutment member pivots upon abutting against said dog at the beginning of the brake inhibit interval.

6. A vehicle according to claim 1, wherein said brake switching mechanism further comprises releasing means for releasing a brake transmission mechanism of said brake unit when said abutment member pivots upon abutting against said dog at the beginning of the brake inhibit interval.

* * * * *

UNITED STATES PATENT AND TRADEMARK OFFICE

CERTIFICATE OF CORRECTION

PATENT NO. : 4,548,136

DATED : October 22, 1985

INVENTOR(S) : Kazuo Yamada

It is certified that error appears in the above-identified patent and that said Letters Patent is hereby corrected as shown below:

Column 10, line 19, delete the numeral "1" and insert the numeral --2--.

Signed and Sealed this

*Twenty-ninth* Day of *July 1986*

[SEAL]

*Attest:*

DONALD J. QUIGG

*Attesting Officer*

*Commissioner of Patents and Trademarks*